US007331656B2

(12) United States Patent
Shinohara et al.

(10) Patent No.: US 7,331,656 B2
(45) Date of Patent: Feb. 19, 2008

(54) INK JET RECORDING HEAD AND METHOD OF MANUFACTURING THE SAME

(75) Inventors: Akinori Shinohara, Kanagawa (JP); Akemi Ishizaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 11/373,171

(22) Filed: Mar. 13, 2006

(65) Prior Publication Data

US 2006/0214994 A1 Sep. 28, 2006

(30) Foreign Application Priority Data

Mar. 24, 2005 (JP) ..... 2005-086028

(51) Int. Cl.
*B41J 2/05* (2006.01)

(52) U.S. Cl. ..... 347/65; 347/40; 347/43; 347/47

(58) Field of Classification Search ..... 347/65, 347/40, 43, 47
See application file for complete search history.

(56) References Cited

U.S. PATENT DOCUMENTS 5,808,644 A * 9/1998 Imamura et al. ..... 347/93
6,286,941 B1 * 9/2001 Courian et al. ..... 347/65
2002/0036677 A1 * 3/2002 Watanabe et al. ..... 347/65
2006/0001704 A1 * 1/2006 Anderson et al. ..... 347/65

FOREIGN PATENT DOCUMENTS

JP 5-124206 5/1993
JP 6-312506 11/1994

OTHER PUBLICATIONS

Note: Counterpart U.S. patent also cited (see text of IDS).

* cited by examiner

*Primary Examiner*—Matthew Luu
*Assistant Examiner*—Joshua M Dubnow
(74) *Attorney, Agent, or Firm*—Fitzpatrick, Cella, Harper & Scinto

(57) ABSTRACT

An ink jet recording head, which can effectively prevent any bubble and solid matter such as dust existing in supplied ink to reach the vicinity of a nozzle, includes a plurality of energy generating elements for generating energy for discharging the ink, a plurality of discharge ports provided at locations opposed to the respective energy generating elements to discharge the ink therethrough, a plurality of ink flow paths communicating with the respective discharge ports, and an ink supplying port for supplying the ink to the plurality of ink flow paths. Water repellent protruding portions having their surfaces formed of a material having surface energy smaller than the interfacial energy between them and the ink are provided upstream of the discharge ports with respect to an ink flow direction in which the ink flows from the ink supplying port into the ink flow paths and is discharged from the discharge ports.

4 Claims, 7 Drawing Sheets

INK JET RECORDING HEAD AND METHOD OF MANUFACTURING THE SAME

BACKGROUND OF THE INVENTION

1. Field of the Invention

This invention relates to an ink jet recording head for discharging ink to thereby effect recording on a recording medium, and a method of manufacturing the same.

2. Description of Related Art

An ink jet recording head is provided with a discharge port for discharging ink, an ink flow path for supplying the ink to the discharge port, an energy generating element provided in a portion of the ink flow path for generating energy for discharging the ink, and an ink supplying port for supplying the ink to the ink flow path.

The ink jet recording head in recent years is very small in the discharge port (hereinafter referred to as the "nozzle") in order to realize the recording of an image of high quality and a higher speed. In contrast, Japanese Patent Application Laid-open No. H06-312506 and Japanese Patent Application Laid-open No. H05-124206 disclose a construction in which a pillar-shaped dust catching member (filter) is formed near an ink flow path to thereby catch solid matter such as minute dust in ink and prevent the clogging of the ink flow path and a discharge port.

In the above-described construction of the conventional ink jet recording head, the minute dust in the ink can be caught by the filter, but when a bubble exists in the ink, the bubble may not in some cases be caught by the filter. Therefore, the minute bubble may sometimes come from the ink supplying port into the ink flow path and reach the vicinity of the discharge port. When the bubble reaches the vicinity of the discharge port, there is the undesirable possibility that normal discharge is not effected, for example, in case of ink discharge, the discharge direction of the ink deviates or the discharge amount of the ink changes. Also, when the bubble having reached the vicinity of the discharge port is large, for example, to such a degree as covers the energy generating element, the ink is sometimes not discharged from the nozzle.

SUMMARY OF THE INVENTION

The present invention can provide an ink jet recording head which can make it difficult for any bubble and solid matter such as dust existing in supplied ink to reach the vicinity of a discharge port, and a method of manufacturing the same.

In one aspect, the ink jet recording head of the present invention is an ink jet recording head including a plurality of energy generating elements for generating energy for discharging ink, a plurality of discharge ports provided at locations opposed to the respective energy generating elements for discharging the ink therethrough, a plurality of ink flow paths communicating with the respective discharge ports, and an ink supplying port for supplying the ink to the plurality of ink flow paths, characterized in that a first protruding portion having its surface formed of a material lower in surface energy than the surface of a material forming the ink flow paths is provided upstream of the discharge ports with respect to an ink flow direction in which the ink flows from the ink supplying port into the ink flow paths and is discharged from the discharge ports.

According to the above-described present invention, any bubble and solid matter such as dust existing in the supplied ink are adsorbed to the first protruding portion and therefore, it can be made difficult for them to reach the vicinity of the discharge ports.

DETAILED DESCRIPTION OF THE PREFERRED EMBODIMENTS

Some embodiments of the present invention will hereinafter be described with reference to the drawings.

Figure 1:
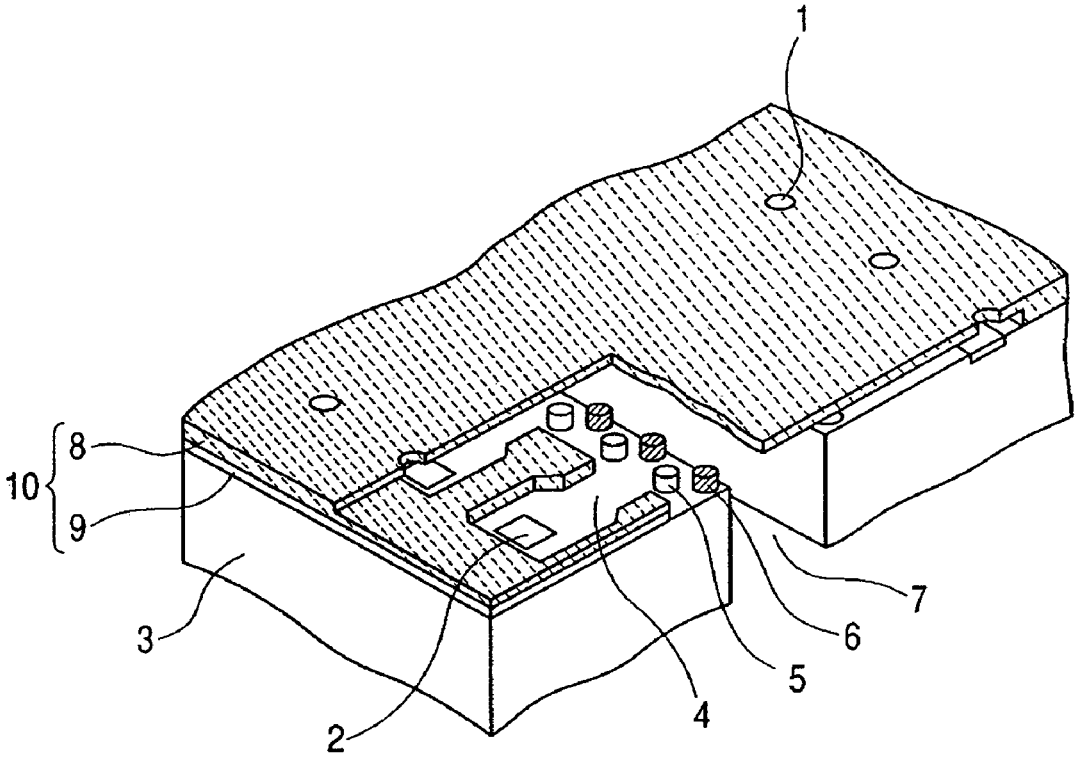
FIG. 1 is a perspective view showing an ink jet recording head according to an embodiment of the present invention in a partly broken-away state.

FIG. 1 is a perspective view showing an ink jet recording head according to an embodiment of the present invention in a partly broken-away state.

The ink jet recording head shown in FIG. 1 is provided with a nozzle plate 10 and a semiconductor substrate 3. The nozzle plate 10 is provided with a plurality of discharge ports 1 for discharging ink therethrough, and a plurality of ink flow paths 4 communicating with the respective discharge ports 1 for supplying the ink thereto. On the other hand, the semiconductor substrate 3 is provided with energy generating elements 2 corresponding to the respective ink flow paths 4 and generating energy for discharging the ink, and also is provided with an ink supplying port 7 formed through the semiconductor substrate 3 to supply the ink to the ink flow paths 4. The plurality of discharge ports 1 and the ink flow paths 4 communicating therewith are arranged along the ink supplying port 7 on the opposite sides of the ink supplying port 7 formed in the substrate 3.

Further, the ink jet recording head according to the present embodiment is provided with hydrophilic protruding portions 5 and water repellent protruding portions 6 in an area near the entrances of the ink flow paths 4 and upstream of the entrances of the ink flow paths 4 with respect to the flow direction of the ink flowing into the ink flow paths 4 and discharged from the discharge ports 1. These hydrophilic protruding portions 5 and water repellent protruding portions 6 are also arranged along the ink supplying port 7 on the opposite sides of the ink supplying port 7. Both of the row of the hydrophilic protruding portions 5 and the row of the water repellent protruding portions 6 are such that the protruding portions 5 and 6 are arranged at the same predetermined pitch, but the row of the hydrophilic protruding portions 5 and the row of the water repellent protruding portions 6 deviate from each other by a half pitch in the arrangement directions thereof.

If the arrangement pitches of the protruding portions 5 and 6 are too narrow, it will become a hindrance to the flow of the ink and will reduce the response frequency of a discharging operation to thereby cause an impediment to high-speed recording. Therefore, it is preferable that at least the water repellent protruding portions 6 be arranged at intervals equal to or wider than the diameter of the discharge ports. Thereby, it is possible to suppress the water repellent protruding portions 6 from increasing the resistance of the flow paths 4 and ink discharged from the discharge ports 1 to such a degree as will cause an impediment to the discharging operation. The hydrophilic protruding portions 5 are juxtaposed with the water repellent protruding portions 6 at intervals equal to or narrower than the diameter of the discharge ports so as to be capable of catching dust more minute than the interval between adjacent water repellent protruding portions 6.

FIGS. 2A to 2H are cross-sectional views showing a method of manufacturing the ink jet recording head shown in FIG. 1 in the order of steps. The manufacturing steps of the ink jet recording head shown in FIG. 1 will now be described with reference to FIGS. 2A to 2H.

Figure 2A:
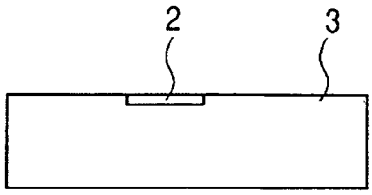
FIGS. 2A, 2B, 2C, 2D, 2E, 2F, 2G and 2H are cross-sectional views showing a method of manufacturing the ink jet recording head shown in FIG. 1 in the order of steps.

First, as shown in FIG. 2A, a plurality of energy generating elements 2 such as electro-thermal converting members are constituted on the semiconductor substrate 3. By these energy generating elements 2, discharging energy for discharging ink droplets is given to the ink.

Figure 2B:
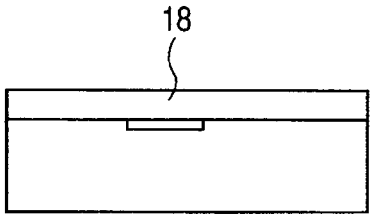
Figure 2C:
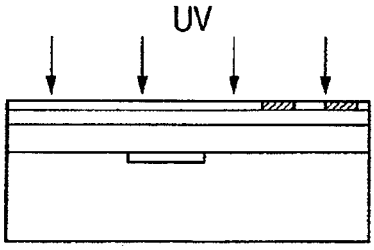
Figure 2D:
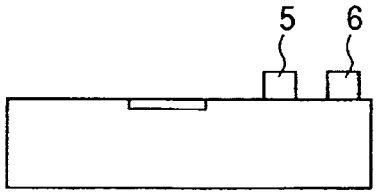

Then, as shown in FIG. 2B, photosensitive resin 18 is uniformly formed on the semiconductor substrate 3 by a spin coat, a roll coater or the like, whereafter the patterning thereof is effected by a photolithography method (FIG. 2C), to thereby form the protruding portions 5 and 6 (FIG. 2D). The protruding portions 5 and 6 in the present embodiment are disposed in the area between the exit of the ink supplying port 7 and the entrances of the ink flow paths 4 on the semiconductor substrate 3, as described above. These protruding portions 5 and 6 function as filters for catching any bubble, dust, etc. contained in the ink supplied from the ink supplying port 7 to the ink flow paths 4. The protruding portions 5 and 6 can be disposed at least upstream of the discharge ports 1 with respect to the flow direction of the ink flowing from the ink supplying port 7 into the ink flow paths 4 and discharged from the discharge ports 1.

Any of positive type photosensitive resin and negative type photosensitive resin may be used as the photosensitive resin 18, but for the purpose of a countermeasure for the contamination at a water repelling process step which will be described later, it is preferable to use the positive type photosensitive resin. The positive type photosensitive resin can be suitably selected for use from among Deep-UV Resist: ODUR-1010 (produced by Tokyo Oka Kogyo Co., Ltd.), AZ-4903 (produced by Hoechst Co., Ltd.), PMER-PG7900 (produced by Tokyo Oka Kogyo Co., Ltd.), etc. As the negative type photosensitive resin, use can be made of epoxy resin, acryl resin, DAP (diallylphthalate) resin or the like.

Among these, epoxy negative type photosensitive resin is composed of at least epoxy resin and onium salt as a photosensitive agent. As the epoxy resin, use can be made of any epoxy resin such as bisphenol A type or F type epoxy resin, bisphenol A type novolak epoxy resin or eresylic novolak epoxy resin. The bisphenol A type epoxy resin can be suitably selected from among Epicoat 1001, 1007, 1010, etc. (produced by Yuka Shell Epoxy Co., Ltd.), and the bisphenol A type novolak epoxy resin can be suitably selected from among Epon SU-8 (produced by Shell Chemical Co., Ltd.), etc. As onium salt, use can be made of SP-150, SP-170 (produced by Adeka Co., Ltd.), Irgacure 261 (produced by Ciba-Geigy Co., Ltd.) or the like.

Figure 2E:
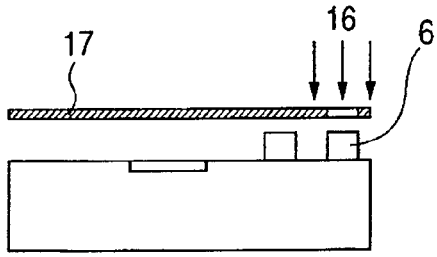
Figure 2F:
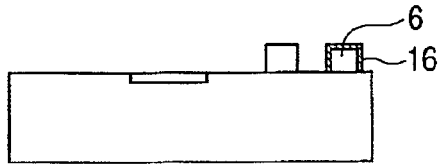

After the protruding portions 5 and 6 have been formed as described above, the surfaces of the protruding portions 6 are subjected to a water repelling process (FIGS. 2E and 2F). Regarding the water repelling process method, there can be selected a method of applying a water repellent material 16 to the surfaces of the protruding portions 6 by a spray through a mask 17 having openings corresponding to the protruding portions 6, as shown in FIG. 2E, or a method of causing water repellent material particles to adhere to the surfaces of the protruding portions 6 by vacuum evaporation or plasma polymerization to thereby make the aforementioned surfaces water-repellent. As the water repellent material, use can preferably be made, for example, of compounds of the fluorine resin origin. As the compounds of the fluorine resin origin, mention may be made, for example, of polytetrafluoroethylene (PTFE), and specifically, Polyflon TFE (produced by Daikin Kogyo Co., Ltd.), Teflon TFE (produced by Du Pont Inc.), etc. Also, recently, there is known transparent fluorine resin having annular structure in a principal chain, and specifically Cytop (produced by Asahi Glass Co., Ltd.) or the like. Further, use can also be made of other resins containing fluorine atoms, such as, for example, fluoride epoxy resin, fluoride polyimide resin, fluoride polyurethane resin, fluoride polysyloxane resin and denatured resins of those, etc. Or use may be made of a water repelling processing agent containing silicon atoms or silicon resin.

After the water repelling processing, a through-aperture (not shown) for supplying the ink is formed in the semiconductor substrate 3. As a method of forming the through-aperture, sand blast working or an etching method by an alkali solution or the like can be suitably selected.

Figure 2G:
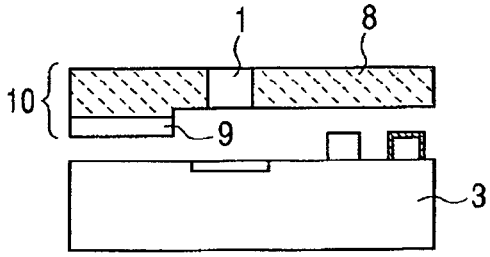
Figure 2H:
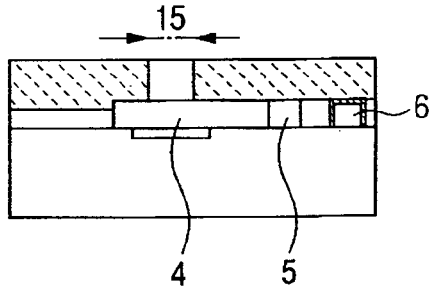

Then, as shown in FIG. 2G, the nozzle plate 10 formed with grooves forming the ink flow paths 4 and the discharge ports 1 is positioned on the semiconductor substrate 3. Then, the nozzle plate 10 is urged against the semiconductor substrate 3 and at the same time, the joined region of the two is heated to thereby adhesively secure an adhesive layer 9 provided on the joined surface of the nozzle plate 10 to the substrate 3 and the semiconductor substrate 3 to each other. Thereby, as shown in FIG. 2H, the semiconductor substrate 3 and the nozzle plate 10 are joined together, and the ink flow paths 4 are formed between the semiconductor substrate 3 and the nozzle plate 10. Then, filter structure which functions as a filter for minute dust or the like in the ink constituted by the protruding portions 5 and 6 is constructed near the entrances of the ink flow paths 4.

Figure 3:
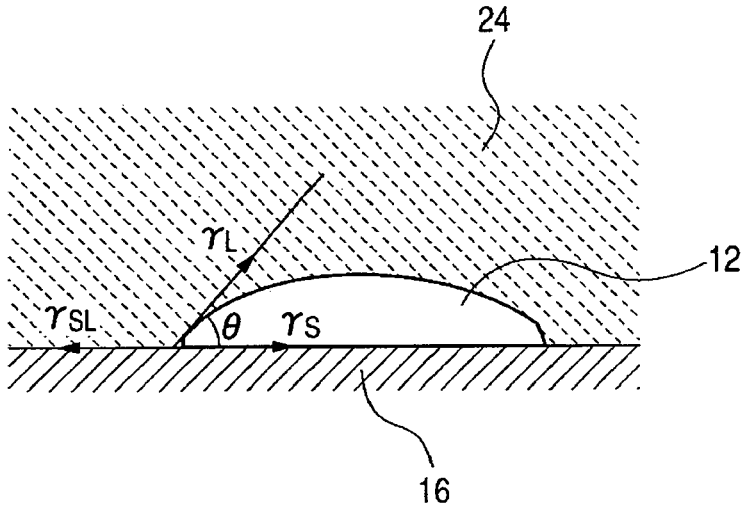
FIG. 3 is an illustration regarding a bubble adhering to the surface of solid matter immersed in liquid.

Here, reference is had to FIG. 3 to effect dynamic consideration regarding a bubble adhering to the surface of solid matter immersed in liquid, and describe a bubble catching function the water repellent protruding portions 6 have.

In FIG. 3, the reference numeral 16 designates the surface of solid matter (the surface of the water repellent material 16 of the water repellent protruding portions 6), the reference numeral 12 denotes a bubble, and the reference numeral 24 designates liquid (ink). Also, a vector $\gamma S$ indicates the surface energy of the solid matter, $\gamma L$ indicates the surface energy of the liquid, $\gamma SL$ indicates the interfacial energy of the liquid and the solid matter, and $\theta$ indicates the contact angle between the bubble and the solid matter.

In a state in which the bubble is stationary while adhering to the surface of the solid matter, there occurs the dynamic balance that $$\gamma SL=\gamma S+\gamma L\cdot\cos\theta.$$

Representing this with regard to cos θ, $$\cos\theta=(\gamma SL-\gamma S)/\gamma L. \quad \text{expression (1)}$$

Here, it is known that when the bubble widens on the surface of the solid matter, it has the relation that $$\gamma SL>\gamma S, \quad \text{expression (2)}$$

and when the bubble contracts on the surface of the solid matter, it has the relation that $$\gamma SL<\gamma S. \quad \text{expression (3)}$$

The hydrophobic surface of a water repellent material or the like repels water and therefore the contact angle θ<90° and thus, 0<cos θ<1, and from expression (1), $$0<(\gamma SL-\gamma S)/\gamma L<1. \quad \text{expression (4)}$$

From expression (4), γSL>γS and therefore, it will be seen that the bubble adhering to this water repellent surface widens on that surface. Accordingly, when a bubble adheres to the water repellent protruding portion 6 in the present embodiment thus provided with a water repellent surface having surface energy smaller than the interfacial energy between it and the liquid (ink), the bubble widens on the surface of the water repellent protruding portion 6. The water repellent protruding portions 6 can catch the bubble in the ink by such a mechanism. On the other hand, the surface of the hydrophilic protruding portion 5 has surface energy greater than the interfacial energy between it and the liquid (ink), and does not catch the bubble.

Figure 4:
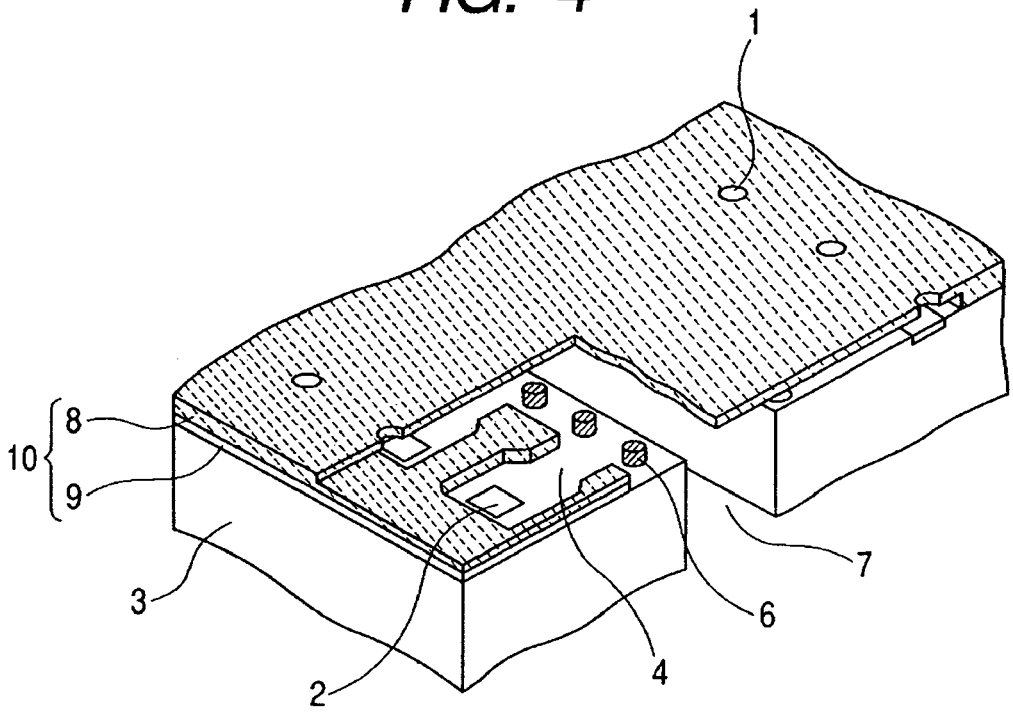
FIG. 4 is a perspective view showing a modification of the ink jet recording head shown in FIG. 1 in a partly broken-away state.

FIG. 4 is a perspective view showing a modification of the ink jet recording head shown in FIG. 1 in a partly broken-away state. As shown in FIG. 4, the above-described filter structure may be constituted by only the water repellent protruding portions 6.

Some embodiments of the present invention will hereinafter be described with reference to the drawings.

Embodiment 1

FIGS. 5A to 5H are typical perspective views showing a method of manufacturing the ink jet recording head shown in FIG. 4 in the order of steps.

Figure 5A:
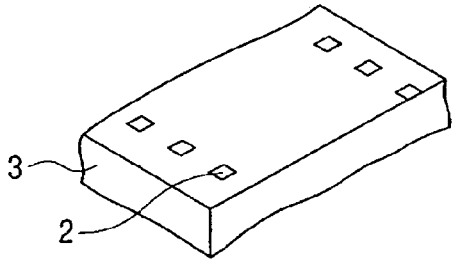
FIGS. 5A, 5B, 5C, 5D, 5E, 5F, 5G and 5H are typical perspective views showing a method of manufacturing the ink jet recording head shown in FIG. 4 in the order of steps.
Figure 5B:
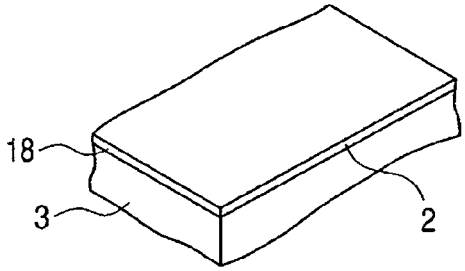

First, as shown in FIG. 5A, a desired plurality of liquid discharging energy generating elements 2 such as electrothermal converting members were provided on the semiconductor substrate 3. Then, as shown in FIG. 5B, negative type photosensitive epoxy resin 18 was applied onto the semiconductor substrate 3 by a spin coat method. As the photosensitive epoxy resin 18, use was made of SU-8 (produced by Shell Chemical Co., Ltd.) which is epoxy resist having onium salt as a photosensitive agent, and it was applied with a thickness of 30 μm.

Figure 5C:
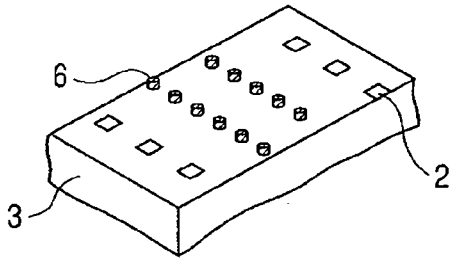
Figure 5D:
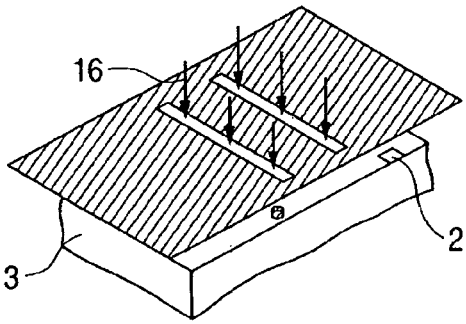
Figure 5E:
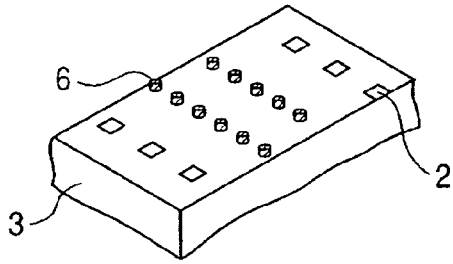

Thereafter, prebaking for heating this negative type photosensitive epoxy resin 18 at 90° C. for 5 minutes was effected by the use of a hot plate, and exposure of 2 J/cm$^2$ was effected by the use of MPA600 (produced by Canon Inc.) which is a mirror projection aligner. Thereafter, post-exposure baking (PEB) for heating the negative type photosensitive epoxy resin 18 at 90° C. for 5 minutes was effected again by the use of the hot plate. Further, development was effected by the use of propylene glycol 1-monoethyl ether acetate produced by Kishida Kagaku Co., Ltd. to thereby form the protruding portions 6 at predetermined locations (FIG. 5C). The protruding portions 6 are not subjected to a heating step and therefore are in a half-hardened state at this point of time.

Then, the surfaces of the protruding portions 6 were subjected to a water repelling process. As a water repellent material 16, use was made of a mixture of 100 parts of Cytop CT-805A (produced by Asahi Glass Co., Ltd.) and 100 parts of CT Solve 100 (produced by Asahi Glass Co., Ltd.), and this mixture was applied to the surfaces of the protruding portions 6 by a spray method through the mask 17.

Figure 5F:
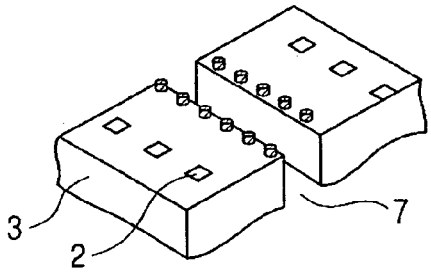

Then, a blast mask (not shown) was installed on the semiconductor substrate 3, and a through-aperture for ink supply (ink supplying port) 7 was formed by sand blast working (FIG. 5F).

Figure 5G:
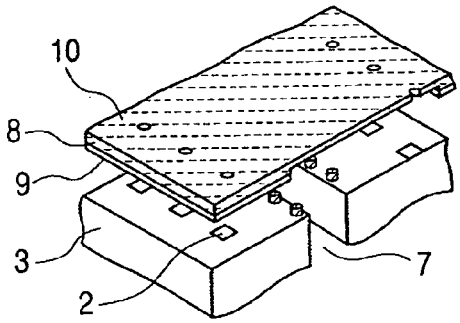

Then, a nozzle plate 10 formed with grooves forming the ink flow paths 4 and the discharge ports 1 by laser working was strictly positioned on the semiconductor substrate 3. Thereafter, the nozzle plate 10 was urged against the semiconductor substrate 3 and at the same time, the joined region of the two was heated to thereby adhesively secure an adhesive layer 9 provided on the nozzle plate 10 and the semiconductor substrate 3 to each other. At the same time, the activated protruding portions 6 were hardened, and were adhesively secured to the nozzle plate 10 (FIG. 5G).

Figure 5H:
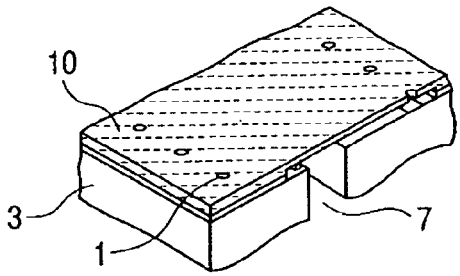

Thereby, as shown in FIG. 5H, the ink flow paths 4 were formed between the semiconductor substrate 3 and the nozzle plate 10 after joined together and also, filter structure which functions as a filter for minute dust or the like in the ink was constituted by the protruding portions 6 near the entrances of the ink flow paths 4.

The nozzle plate 10 is a resin sheet comprising multi-later structure of a polymer layer 8 and an adhesive layer 9. Polyimide (Eupilex, produced by Ube Kosan Co., Ltd.) is selected as the material of the polymer layer 8 in the present embodiment. It can be arbitrarily selected from among such resins as polysalfone, polyphenylene sulfide, apolyphenylene oxide, polyamideimide and polycarbonate generally used as base film. Also, the material of the adhesive layer 9 is arbitrarily selected from among such thermosetting type adhesive agents as epoxy resin, phenol resin, urethane resin, thermosetting vinyl resin and amino resin. The thickness of the polymer layer in the present embodiment is 50 μm, and the thickness of the adhesive layer 9 is 12 μm.

Embodiment 2

The protruding portions 6 in Embodiment 1 have the function of catching dust, besides the function of catching any bubble in the ink, but the interval between adjacent ones of the protruding portions 6 is an interval equal to or wider than the diameter of the discharge ports 1 and therefore, the function as a filter for dust may not always be satisfied. So, in order to enhance the filter function to thereby catch more minute dust, protruding portions 5 as a filter for dust catching function may be formed besides the protruding portions 6.

FIGS. 6A to 6H are typical perspective views showing a method of manufacturing the ink jet recording head shown in FIG. 1 in the order of steps.

Figure 6A:
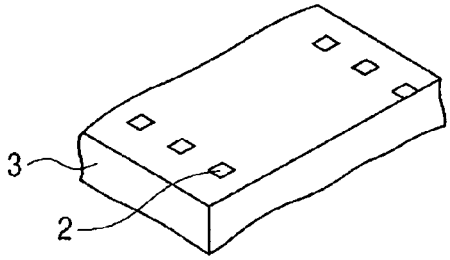
FIGS. 6A, 6B, 6C, 6D, 6E, 6F, 6G and 6H are typical perspective views showing the method of manufacturing the ink jet recording head shown in FIG. 1 in the order of steps.
Figure 6B:
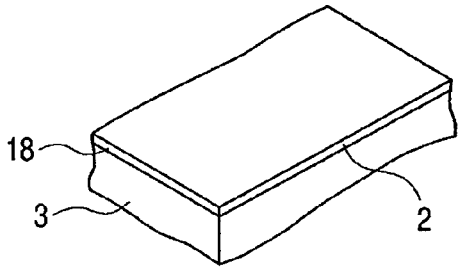
Figure 6C:
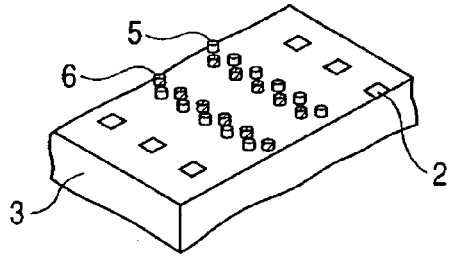
Figure 6D:
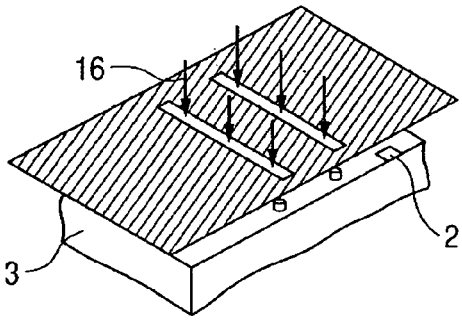
Figure 6E:
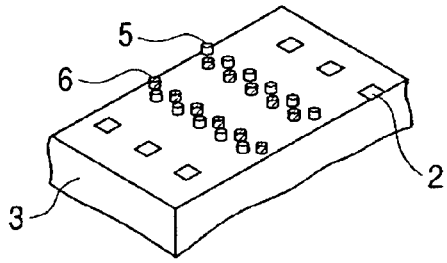
Figure 6F:
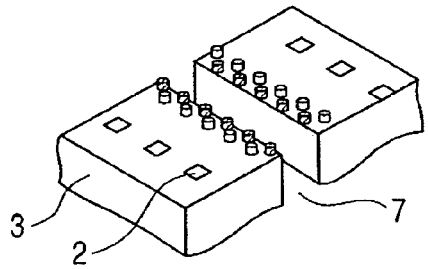
Figure 6G:
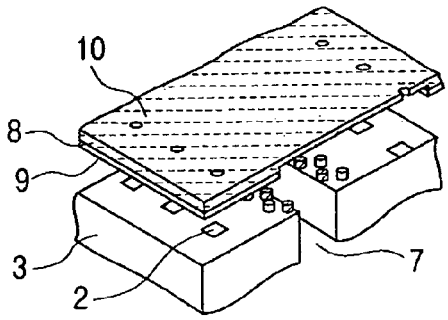
Figure 6H:
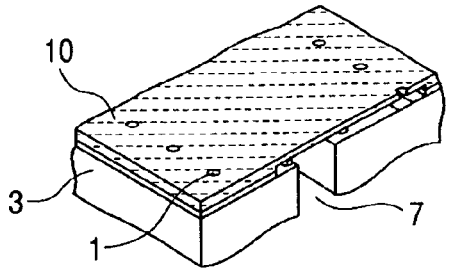

The protruding portions 5 can be formed simultaneously with the protruding portions 6 at the step shown in FIG. 6C. The details of the forming step are as described with reference to FIG. 5C in Embodiment 1. Thereafter, at the step shown in FIG. 6D, the water repelling process is effected on only the protruding portions 6, and the subsequent steps are executed as in Embodiment 1, whereby there is manufactured an ink jet recording head of the construction shown in FIG. 1 which is provided with the hydrophilic protruding portions 5 and the hydrophobic protruding portions 6. The surface of the epoxy resin 18 has surface energy greater than the interfacial energy between it and the ink and therefore, the protruding portions 5 having had their surfaces not subjected to the water repelling process are hydrophilic to the ink.

Various arrangement examples of the hitherto described protruding portions 5 and 6 will be described here with reference to FIGS. 7A to 7F.

Figure 7A:
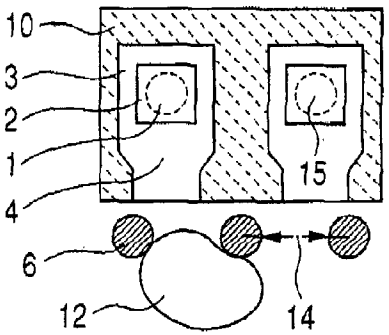
FIGS. 7A, 7B, 7C, 7D, 7E and 7F show various arrangement examples of a protruding portion.

In the arrangement example shown in FIG. 7A, a plurality of water repellent protruding portions 6 only are disposed on the semiconductor substrate 3 at intervals 14 equal to or wider than the width 15 of the discharge ports 1 along a direction crossing the flow direction of the ink flowing from the ink supplying port 7 into the ink flow paths 4. Here, the direction crossing the flow direction of the ink flowing from the ink supplying port 7 into the ink flow paths 4 is a direction orthogonal to the ink flow direction in the examples shown in FIGS. 7A to 7F.

Figure 7B:
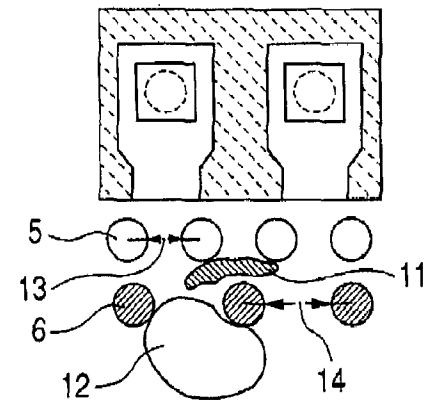

In the arrangement example shown in FIG. 7B, a plurality of water repellent protruding portions 6 are disposed on the semiconductor substrate 3 at intervals equal to or wider than the width of the discharge ports 1 along a direction crossing the ink flow direction. Also, a plurality of hydrophilic protruding portions 5 are disposed on the semiconductor substrate 3 at intervals equal to or narrower than the width of the discharge ports 1 along the direction crossing the ink flow direction. The row of the water repellent protruding portions 6 is located on a side opposite to the row of the ink flow paths 4 (i.e., a side near to the ink supplying port 7) with the row of the hydrophilic protruding portions 5 interposed therebetween. Also, in the arrangement example shown in FIG. 7C, the disposed positions of the hydrophilic protruding portions 5 and the water repellent protruding portions 6 are converse to those in FIG. 7B.

Figure 7C:
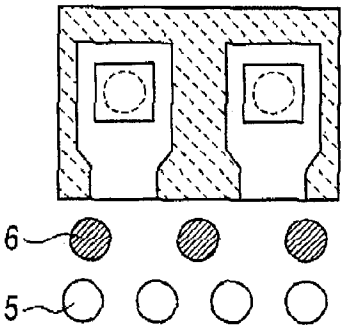

In the case of the arrangement examples shown in FIGS. 7B and 7C, even if dust 11 in the ink is smaller than the interval 14 between adjacent ones of the water repellent protruding portions 6 and passes between them, the interval 15 between adjacent ones of the hydrophilic protruding portions 5 is smaller than the diameter 15 of the discharge ports 1. Therefore, it never happens that dust larger than the diameter 15 of the discharge ports 1 passes between adjacent ones of the hydrophilic protruding portions 5. Even if there is any dust passing between adjacent ones of the hydrophilic protruding portions 5, it is smaller than the diameter of the discharge ports 1 and therefore is discharged from the discharge ports 1 together with the ink. Thus, according to the arrangement examples shown in FIGS. 7B and 7C, more minute dust can also be caught efficiently. To extract the bubble catching function by this filter structure, it is preferable to adopt a construction in which the water repellent protruding portions 6 having a strong bubble adsorbing property, as described above are disposed on the ink supplying port 7 side as shown in FIG. 7B.

Figure 7D:
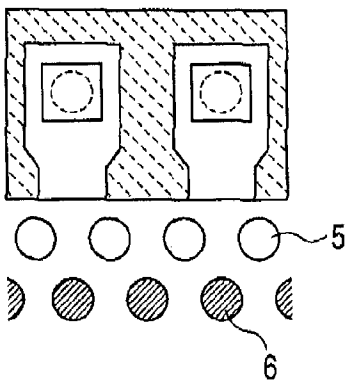

In the arrangement example in FIG. 7D, the hydrophilic protruding portions 5 and the water repellent protruding portions 6 are arranged parallel to each other along the row of the ink flow paths 4. Both of the row of the hydrophilic protruding portions 5 and the row of the water repellent protruding portions 6 are such that the protruding portions 5 and 6 are arranged at the same predetermined pitch, but the row of the hydrophilic protruding portions 5 and the row of the water repellent protruding portions 6 deviate by a half pitch from each other in the arrangement directions thereof, and the protruding portions 5 and 6 are in a staggeredly arranged state. In this case, the arrangement relations of the hydrophilic protruding portions 5 and the water repellent protruding portions 6 may be converse, but to extract the bubble atching function by the filter structure, it is preferable to adopt a construction in which the water repellent protruding portions 6 are disposed on the ink supplying port 7 side.

Figure 7E:
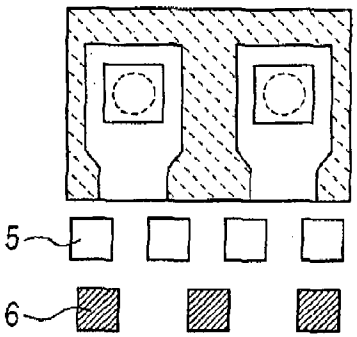
Figure 7F:
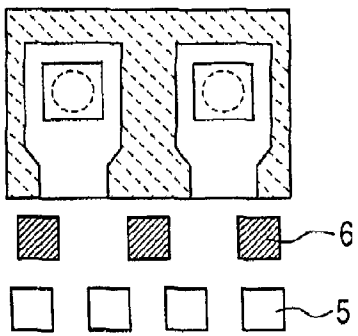

Also, the cross-sectional shapes of the protruding portions 5 and 6 may be a circular shape as shown in FIGS. 7A to 7D, or may be a square shape or a rectangular shape as shown in FIGS. 7E and 7F. As long as a reduction in the filter function and the flow resistance of the ink are not increased, there may be adopted any shape which is convenient in case of the manufacturing process.

If a bubble occurs in the ink flow paths 4, the forms shown in FIGS. 7B, 7D and 7E are more desirable in respect of the removability of the bubble than the forms shown in FIGS. 7A, 7C and 7F.

Embodiment 3

FIGS. 8A to 8H are typical perspective views showing another method of manufacturing the ink jet recording head shown in FIG. 1 in the order of steps.

Figure 8A:
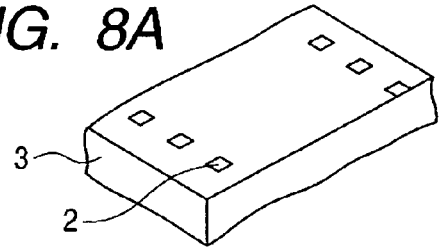
FIGS. 8A, 8B, 8C, 8D, 8E, 8F, 8G, 8H and 8I are typical perspective views showing another method of manufacturing the ink jet recording head shown in FIG. 1 in the order of steps.
Figure 8B:
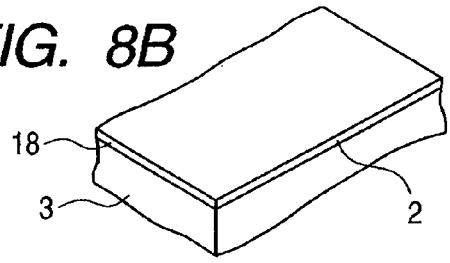
Figure 8C:
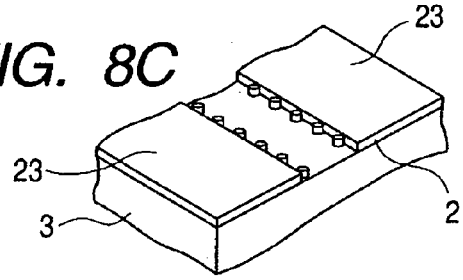

First, as shown in FIG. 8A, a desired plurality of liquid discharging energy generating elements 2 such as electrothermal converting members were provided on the semiconductor substrate 3. Then, as shown in FIG. 8B, AZ-4903 (produced by Hoechst Co., Ltd.) as positive type photosensitive resin was applied onto the semiconductor substrate 3 by a spin coat method so that the film thickness thereof might be 30 μm, and prebaking was effected in an oven at 90° C. for 40 minutes to thereby form a photosensitive resin layer 18. Pattern exposure was effected on this photosensitive resin layer 18 with an exposure amount of 800 mj/cm$^2$ by a mask aligner PLA-501 (produced by Canon Inc.) through a pattern mask (not shown), whereafter development was effected by the use of a sodium hydroxide water solution of 0.75 wt. %. Thereafter, after rinse processing, post-baking was effected in a vacuum oven at 50° C. for 30 minutes, to thereby obtain a resist pattern 23 remaining covering the energy generating element 2 (FIG. 8C).

Figure 8D:
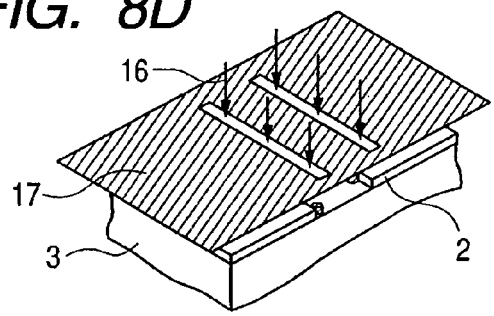
Figure 8E:
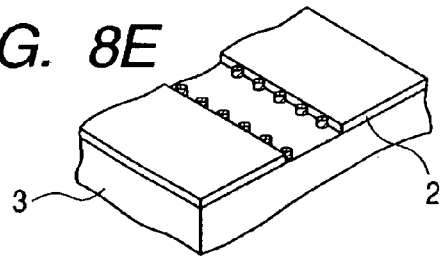
Figure 8F:
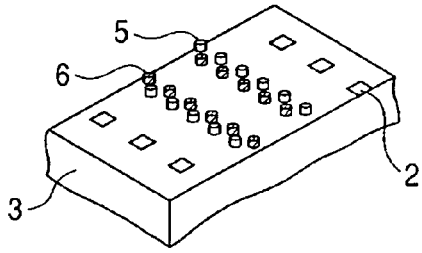

Then, a water repellent material 16 was caused to adhere to a predetermined portion of the obtained resist pattern 23 by plasma polymerization, and this was made water-repellent. Specifically, by a plasma discharging apparatus, CF4 as a raw material gas was introduced from a carrier gas supplying path under pressure of 1 Torr, and high frequency electric power of 50 W and 13.6 MHz was applied thereto to thereby cause discharge. Then, a plasma discharging process was carried out for 0.5 minute through a mask to thereby form water repelling film on a predetermined portion of the resist pattern 23 (FIGS. 8D and 8E).

Besides this, as the water repellent material 16, use can be made of any of a saturated carbon fluoride compound and a fluorine sulfide compound which are gases at an ordinary temperature or are gasified at a temperature during a discharging process, and besides $CF_4$, $C_2F_6$ or $SF_6$ or the like may be selected as the raw material gas.

Then, a predetermined location on the resist pattern 23 was pattern-exposed again with an exposure amount of 800 mj/cm$^2$ through the pattern mask (not shown), whereafter development was effected by the use of a sodium hydroxide water solution of 0.75 wt. %. Thereafter, rinse processing was effected, and post-baking was effected in a vacuum oven at 70° C. for 30 minutes to thereby obtain protruding portions 5 and 6.

Figure 8G:
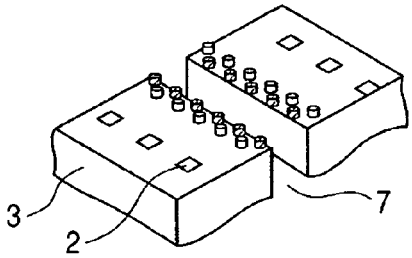
Figure 8H:
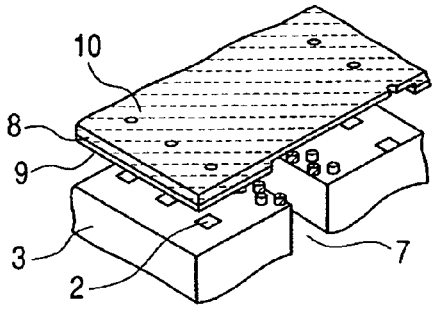
Figure 8I:
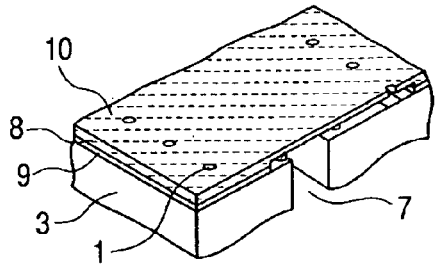

Then, a blast mask was installed on the semiconductor substrate 3, and a through-aperture (ink supplying port) 7 for ink supply was formed by sand blast working (FIG. 8G). Then, a nozzle plate 10 formed with grooves forming ink flow-paths 4 and discharge ports 1 by laser working was positioned on the semiconductor substrate 3. Then, the nozzle plate 10 was urged against the semiconductor substrate 3 and at the same time, the joined region of the two was heated, whereby an adhesive layer 9 provided on the nozzle plate 10 and the semiconductor substrate 3 were adhesively secured to each other (FIG. 8H). Thereby, as shown in FIG. 8I, ink flow paths 4 were formed between the semiconductor substrate 3 and the nozzle plate 10 after joined together. Then, filter structure which functions as a filter for minute dust, etc. in the ink was constituted near the entrances of the ink flow paths 4 by the protruding portions 5 and 6. The nozzle plate 10 was the same as that used in Embodiment 1.

According to the present embodiment, after the patterning of the protruding portions, the water repelling process which is the next step is carried out with the energy generating elements 2 remaining covered with the photosensitive resin layer 18, whereby this photosensitive resin layer 18 functions as protective film for the water repellent material 16 of the energy generating elements 2. After the water repelling process, the photosensitive resin layer 18 on the energy generating elements 2 is removed, whereby it is possible to prevent the water repellent material 16 from adhering into and onto the energy generating elements 2, or the hydrophilic protruding portions 5 from being coated with the water repellent material 16 and being made water-repellent.

This application claims priority from Japanese Patent Application No. 2005-086028 filed Mar. 24, 2005, which is hereby incorporated by reference herein.

What is claimed is:

1. An ink jet recording head having:

a plurality of energy generating elements for generating energy for discharging ink;

a plurality of discharge ports provided at locations opposed to respective ones of said energy generating elements;

a plurality of ink flow paths communicating with respective ones of said discharge ports; and an ink supplying port for supplying the ink to said plurality of ink flow paths;

wherein a first protruding portion having its surface formed of a material having a surface energy smaller than the interfacial energy between it and an ink is provided upstream of said discharge ports with respect to an ink flow direction in which the ink flows from said ink supplying port into said ink flow paths and is discharged from said discharge ports.

2. An ink jet recording head according to claim 1, wherein the material forming the surface of said first protruding portion is a water repellent material.

3. An ink jet recording head according to claim 1, wherein a second protruding portion having its surface formed of a material having a surface energy greater than the interfacial energy between it and an ink is provided upstream of said discharge ports with respect to said ink flow direction.

4. An ink jet recording head according to claim 3, wherein a plurality of said first protruding portions are provided at intervals equal to or wider than the diameter of said discharge ports along a direction crossing said ink flow direction, and a plurality of said second protruding portions are provided at intervals equal to or narrower than the diameter of said discharge ports along the direction crossing said ink flow direction.

* * * * *

UNITED STATES PATENT AND TRADEMARK OFFICE

CERTIFICATE OF CORRECTION

PATENT NO. : 7,331,656 B2
APPLICATION NO. : 11/373171
DATED : February 19, 2008
INVENTOR(S) : Shinohara et al.

It is certified that error appears in the above-identified patent and that said Letters Patent is hereby corrected as shown below:

COLUMN 7:
Line 42, “15 between” should read --13 between--.
Line 56, “above” should read --above,--.

COLUMN 8:
Line 5, “atching” should read --catching--.

COLUMN 9:
Line 8, “flow-paths” should read --flow paths--.

COLUMN 10:
Line 11, “paths;” should read --paths,--.

Signed and Sealed this

Third Day of March, 2009

John Doll

JOHN DOLL
*Acting Director of the United States Patent and Trademark Office*